US011313016B2

(12) United States Patent
Xiong et al.

(10) Patent No.: US 11,313,016 B2
(45) Date of Patent: Apr. 26, 2022

(54) ALUMINUM ALLOY MATERIALS SUITABLE FOR THE MANUFACTURE OF AUTOMOTIVE BODY PANELS AND METHODS FOR PRODUCING THE SAME

(71) Applicant: GENERAL RESEARCH INSTITUTE FOR NONFERROUS METALS, Beijing (CN)

(72) Inventors: Baiqing Xiong, Beijing (CN); Xiwu Li, Beijing (CN); Yongan Zhang, Beijing (CN); Zhihui Li, Beijing (CN); Hongwei Liu, Beijing (CN); Feng Wang, Beijing (CN)

(73) Assignee: General Research Institute for Nonferrous Metals, Beijing (CN)

( * ) Notice: Subject to any disclaimer, the term of this patent is extended or adjusted under 35 U.S.C. 154(b) by 477 days.

(21) Appl. No.: 14/785,569

(22) PCT Filed: Sep. 29, 2013

(86) PCT No.: PCT/CN2013/084591
§ 371 (c)(1),
(2) Date: Oct. 19, 2015

(87) PCT Pub. No.: WO2014/169585
PCT Pub. Date: Oct. 23, 2014

(65) Prior Publication Data

US 2016/0083818 A1 Mar. 24, 2016

(30) Foreign Application Priority Data

Apr. 19, 2013 (CN) ..... 2013 1 0138522

(51) Int. Cl.
*B22D 7/00* (2006.01)
*C22C 21/00* (2006.01)
(Continued)

(52) U.S. Cl.
CPC ..... *C22C 21/18* (2013.01); *B22D 7/005* (2013.01); *C22C 1/026* (2013.01); *C22C 21/00* (2013.01);
(Continued)

(58) Field of Classification Search
None
See application file for complete search history.

(56) References Cited

U.S. PATENT DOCUMENTS

2007/0209739 A1 9/2007 Zhao
2009/0148721 A1* 6/2009 Hibino ..... C22C 21/02 428/650
2016/0083818 A1 3/2016 Xiong et al.

FOREIGN PATENT DOCUMENTS

CN 1867689 A 11/2006
CN 1914348 A 2/2007
(Continued)

OTHER PUBLICATIONS

Uchida et al (KR 10-2003-0080100), English Translation from K-PION (Year: 2003).*

*Primary Examiner* — Colin W. Slifka
(74) *Attorney, Agent, or Firm* — Christensen, Fonder, Dardi & Herbert PLLC

(57) ABSTRACT

An aluminum alloy material suitable for the manufacture of automotive body panels comprising: Si 0.6 to 1.2 wt %, Mg 0.7 to 1.3 wt %, Zn 0.25 to 0.8 wt %, Cu 0.02 to 0.20 wt %, Mn 0.01 to 0.25 wt %, Zr 0.01 to 0.20 wt %, with the balance being Al and incidental elements, based on the total weight of the aluminum alloy material. The aluminum alloy material satisfies the inequation of: 2.30 wt %≤(Si+Mg+Zn+2Cu) wt %≤3.20 wt %.

20 Claims, 1 Drawing Sheet

(51) Int. Cl.

| | |
|---|---|
| ***C22C 21/02*** | (2006.01) |
| ***C22C 21/08*** | (2006.01) |
| ***C22C 21/10*** | (2006.01) |
| ***C22C 21/14*** | (2006.01) |
| ***C22C 21/16*** | (2006.01) |
| ***C22C 21/18*** | (2006.01) |
| ***C22F 1/00*** | (2006.01) |
| ***C22F 1/04*** | (2006.01) |
| ***C22F 1/043*** | (2006.01) |
| ***C22F 1/047*** | (2006.01) |
| ***C22F 1/053*** | (2006.01) |
| ***C22F 1/057*** | (2006.01) |
| ***C22F 1/05*** | (2006.01) |
| ***C22C 1/02*** | (2006.01) |

(52) U.S. Cl.

CPC ..... *C22C 21/02* (2013.01); *C22C 21/08* (2013.01); *C22C 21/10* (2013.01); *C22C 21/14* (2013.01); *C22C 21/16* (2013.01); *C22F 1/002* (2013.01); *C22F 1/04* (2013.01); *C22F 1/043* (2013.01); *C22F 1/047* (2013.01); *C22F 1/05* (2013.01); *C22F 1/053* (2013.01); *C22F 1/057* (2013.01)

(56) References Cited

FOREIGN PATENT DOCUMENTS

| | | | |
|---|---|---|---|
| CN | 101880801 | A | 11/2010 |
| CN | 101935785 | B | 3/2012 |
| CN | 103173661 | A | 6/2013 |
| CN | 103255324 | A | 8/2013 |
| EP | 0 646 655 | A1 | 4/1995 |
| JP | 57-094546 | A | 6/1982 |
| JP | H6-33178 | A | 2/1994 |
| JP | H06-33178 | A | 2/1994 |
| JP | 06-0603 66 | B2 | 8/1994 |
| JP | H8-74014 | A | 3/1996 |
| JP | 2003-221637 | A | 8/2003 |
| JP | 2006-299342 | A | 11/2006 |
| JP | 2009-041045 | A | 2/2009 |
| KR | 10-2003-0080100 | A | 10/2003 |

* cited by examiner

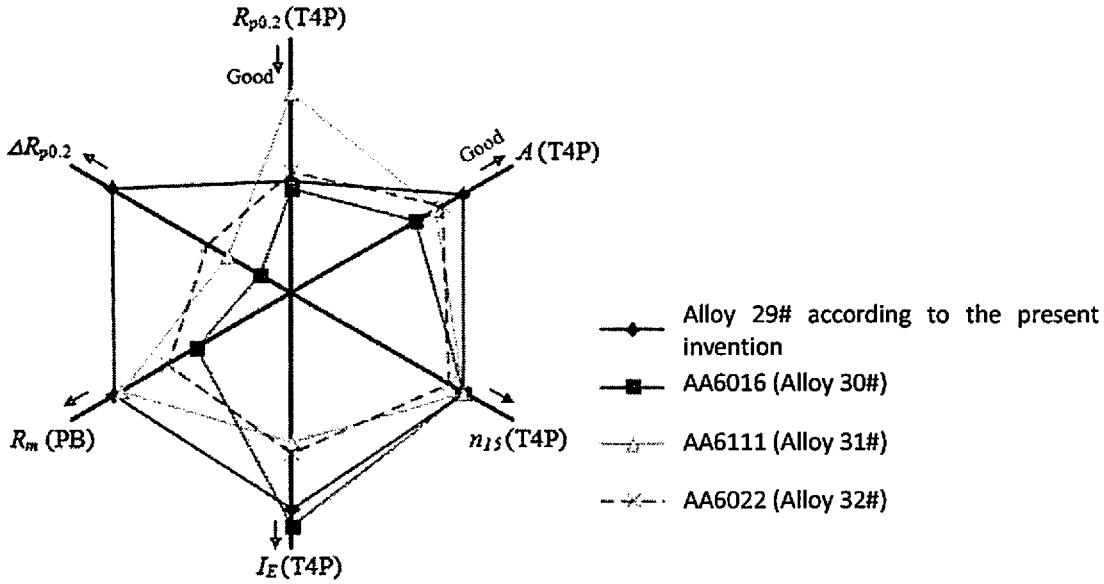
$R_{p0.2}$(T4P)
Good
$\Delta R_{p0.2}$
Good
$A$(T4P)
$R_m$ (PB)
$n_{15}$(T4P)
$I_E$(T4P)
Alloy 29# according to the present invention
AA6016 (Alloy 30#)
AA6111 (Alloy 31#)
AA6022 (Alloy 32#)

ALUMINUM ALLOY MATERIALS SUITABLE FOR THE MANUFACTURE OF AUTOMOTIVE BODY PANELS AND METHODS FOR PRODUCING THE SAME

PRIORITY CLAIM

The present application is a National Phase entry of PCT Application No. PCT/CN2013/084591, filed Sep. 29, 2013, which claims priority from Chinese Patent Application Number 201310138522.3, filed Apr. 19, 2013, the disclosures of which are hereby incorporated by reference herein in their entirety.

TECHNICAL FIELD

The present invention relates to the field of aluminum alloys (also known as Al alloys) and the preparation thereof, especially to 6xxx series aluminum alloys (i.e., Al—Mg—Si-based aluminum alloys) as registered with the International Aluminum Association. In particular, the present invention relates to aluminum alloy materials suitable for the manufacture of automotive body panels and the methods of producing the same.

BACKGROUND

The development of the automotive industry is an important symbol of human civilization and social progress, and also a powerful motive force of economic development. However, with the rapid development of the automotive industry, the resulting problems including energy consumption and environmental contamination become more and more severe. Thus, reduction of fuel oil consumption and the discharge of $CO_2$ and harmful gases and particles to the atmosphere have become significant research subjects in the automotive field.

As an effective way of reducing the consumption rate of automotive fuels and saving energy, the weight reduction of automobiles has become a development trend in the automotive industry throughout the world. An important way to reduce the weight of automobiles is to use light-weight materials for constructing automotive components, especially constructing the automotive bodies which comprise 30% of the total weight of automobiles. Aluminum alloys are desirable light-weight materials used for the manufacture of automotive components due to their various characteristics including light weight, abrasion resistance, corrosion resistance, high specific strength, good impact resistance, ease of surface coloring, recoverability, and the like. Among others, 6xxx series aluminum alloys are believed to be the most promising aluminum alloy materials for the manufacture of automotive bodies.

To further satisfy the requirements for aluminum alloy body panels of automotive industrial development, recently some Chinese and foreign research institutes and enterprises have in succession developed a variety of aluminum alloy materials for automotive body panels with good performances. For instance, the Chinese invention patent application No. CN101880805A discloses an Al—Mg—Si-based aluminum alloy for automotive body panels and a method of preparing the same, said aluminum alloy consisting essentially of: Si: 0.75 to 1.5 wt %, Fe: 0.2 to 0.5 wt %, Cu: 0.2 to 1.0 wt %, Mn: 0.25 to 1.0 wt %, Mg: 0.75 to 1.85 wt %, Zn: 0.15 to 0.3 wt %, Cr: 0.05% to 0.15 wt %, Ti: 0.05 to 0.15 wt %, Zr: 0.05 to 0.35 wt %, and the balance of Al. The material comprises a minor amount of Zn, and an amount of Cu which is near or even higher than the Cu level in 6111 aluminum alloys. However, it can be seen from the performance results provided in the examples that such materials exhibit relatively high yield strength under delivery condition, and limited response capacity to bake hardening (about 50 MPa). Moreover, the Chinese invention patent application No. CN101935785B discloses high-formability aluminum alloys for automotive body panels consisting essentially of: Si: 0.50 to 1.20 wt %, Mg: 0.35 to 0.70 wt %, Cu: 0.01 to 0.20 wt %, Mn: 0.05 to 0.20 wt %, Cr≤0.10 wt %, Zn: 0.01 to 0.25 wt %, Ti≤0.15 wt %, Fe: 0.05 to 0.15 wt %, and the balance of Al. These aluminum alloy materials comprise an amount of Cu which is controlled at a relatively low level, further incorporate a minor amount of Zn element, and are controlled with the concentrations of trace elements. It can be seen from the performance results provided in the examples that such materials exhibit good formability and response capacity to bake hardening, but the strength performance of materials after baking is to be further improved.

For overcoming the defects of performances of existing aluminum alloy materials for automotive body panels, there is still a need of developing novel aluminum alloy materials for automotive body panels which exhibit both high bake hardenability and good formability.

SUMMARY OF INVENTION

The present invention provides an aluminum alloy material suitable for the manufacture of automotive body panels comprising: Si 0.6 to 1.2 wt %, Mg 0.7 to 1.3 wt %, Zn 0.25 to 0.8 wt %, Cu 0.01 to 0.20 wt %, Mn 0.01 to 0.25 wt %, Zr 0.01 to 0.20 wt %, and the balance of Al and incidental elements, based on the total weight of the aluminum alloy material; wherein the aluminum alloy material satisfies the inequation of: 2.30 wt %≤(Si+Mg+Zn+2Cu)≤3.20 t %.

Preferably, the aluminum alloy material comprises: Si 0.6 to 1.2 wt %, Mg 0.7 to 1.2 wt %, Zn 0.3 to 0.6 wt %, Cu 0.05 to 0.20 wt %, Mn 0.05 to 0.15 wt %, Zr 0.05 to 0.15 wt %, and the balance of Al and incidental elements, based on the total weight of the aluminum alloy material; wherein the aluminum alloy material satisfies the inequation of 2.50 wt %≤(Si+Mg+Zn+2Cu)≤3.00 wt %.

The present invention further provides a method of producing an aluminum alloy material comprising:

1) producing cast ingots from the aluminum alloy material according to the present invention;

2) homogenizing the produced ingots;

3) deforming the homogenized ingots via hot rolling and cold rolling processes to produce an aluminum alloy sheet having the desired specification;

4) solution heat treating the deformed aluminum alloy sheet;

5) cooling rapidly the treated aluminum alloy sheet to room temperature; and 6) naturally aging or artificially pre-aging the aluminum alloy sheet.

The present invention further provides a final component made from the aluminum alloy material according to the present invention. Preferably, the final component comprises an external or internal panel of automotive.

BRIEF DESCRIPTION OF DRAWINGS

FIG. 1 indicates a comparison of essential performances among the alloy according to the present invention, 6016 aluminum alloy, 6111 aluminum alloy and 6022 aluminum alloy.

DETAILED DESCRIPTION OF INVENTION

To address the problems that existing, commercially-available 6xxx series (Al—Mg—Si-based) aluminum alloys for automotive body panels exhibiting relatively simple precipitation sequence and primary strengthening phase type and which are unlikely to provide a desirable response capacity to bake hardening, the inventors made a variety of improvements to the existing 6xxx series aluminum alloys. Of those, an appropriate amount of Zn is incorporated as primary alloying element to provide the alloy with a new aging precipitation sequence, thereby significantly enhancing the response capacity to the baking age-hardening of alloys. By controlling the concentration of the alloying element Cu at a relatively low level, it is possible to maintain a relatively good corrosion resistance of alloy while increasing properly the response rate of alloy age hardening. Meanwhile, secondary alloying elements including Zr, Mn, and the like, which are used for microalloying, can facilitate the refining of material structures, as well as the improvement of material properties and surface quality. The refinement and optimization of component levels and element ratios of the alloys are an important guarantee for ensuring the obtainment of a superior performance match. Through reasonable designs, the alloys can precipitate strengthening phases of $Mg_2Si$ structure and $MgZn_2$ structure cooperatively during the baking aging, while keeping a good formability, so that the 6xxx series alloys according to the present invention can achieve a rapid age hardening response during conventional baking treatment, and obtain a more superior service strength. The inventors further find that the complication of polydimensional alloy structure caused by the incorporation of various alloying elements needs to be matched and regulated by optimizing the design of the preparation process thereof.

Thus, the present invention provides an aluminum alloy material suitable for the manufacture of automotive body panels comprising: Si 0.6 to 1.2 wt %, Mg 0.7 to 1.3 wt %, Zn 0.25 to 0.8 wt %, Cu 0.01 to 0.20 wt %, Mn 0.01 to 0.25 wt %, Zr 0.01 to 0.20 wt %, and the balance of Al and incidental elements, based on the total weight of the aluminum alloy material, wherein the aluminum alloy material satisfies the inequation of 2.30 wt %≤(Si+Mg+Zn+2Cu)≤3.20 wt %.

In an aspect, the aluminum alloy material comprises: Si 0.6 to 1.2 wt %, Mg 0.7 to 1.2 wt %, Zn 0.3 to 0.6 wt %, Cu 0.05 to 0.20 wt %, Mn 0.05 to 0.15 wt %, Zr 0.05 to 0.15 wt %, and the balance of Al and incidental elements, based on the total weight of the aluminum alloy material; wherein the aluminum alloy material satisfies the inequation of: 2.50 wt %≤(Si+Mg+Zn+2Cu)≤3.00 wt %.

In another aspect, the aluminum alloy material satisfies the inequation of: 0.75≤10 Mg/(8Si+3Zn)≤1.15.

In still another aspect, the aluminum alloy material satisfies the inequation of: 0.15 wt %≤(Mn+Zr)≤0.25 wt %.

In still another aspect, the incidental elements of the aluminum alloy material refer to the elements which are impurities or are entrained by grain refinement in the manufacture of aluminum alloy ingots (that is, metallic or non-metallic elements in addition to essential alloying elements, including Fe, Ti, Cr, Ni, V, Ag, Bi, Ga, Li, Pb, Sn, B, etc.). The incidental elements according to the present invention comprise Fe, Ti, and one or more selected from other incidental elements, wherein Fe≤0.40 wt %, Ti≤0.15 wt %, each of other incidental elements≤0.15 wt %, and the sum of other incidental elements≤0.25 wt %. Preferably, in the aluminum alloy material, Fe≤0.20 wt %, Ti≤0.10 wt %, each of other incidental elements≤0.05 wt %, and the sum of other incidental elements≤0.15 wt %.

In still another aspect, in the aluminum alloy material, the impurity element Fe and the microalloying element Mn satisfy the inequation of: Fe≤2Mn.

Moreover, the present invention further provides a method of producing an aluminum alloy material comprising the steps of:

1) producing cast ingots from the aluminum alloy material according to the present invention;

2) homogenizing the produced ingots;

3) deforming the homogenized ingots via hot rolling and cold rolling processes to produce an aluminum alloy sheet having the desired specification;

4) solution heat treating the deformed aluminum alloy sheet;

5) cooling the treated aluminum alloy sheet to room temperature rapidly; and 6) naturally aging or artificially pre-aging the aluminum alloy sheet.

Of those, in step (1), the cast ingots are produced by the steps of melting, degasification, removal of inclusion, and DC casting, wherein the concentrations of elements are accurately controlled during melting by use of Mg and Zn as the core elements; and the ratios among alloying elements are rapidly supplemented and adjusted by on-line detection and analysis of components so as to complete the production of cast ingots. In a preferable aspect, step 1) further comprises electromagnetic stirring, ultrasonic stirring, or mechanical stirring during the processes of melting, degasification, removal of inclusion, and DC casting.

In step 2), the homogenization treatment is carried out by means selected from the group consisting of: (1) progressive homogenization treatment in a temperature range of from 360 to 560° C. for 16 to 60 hours; and (2) multi-stage homogenization treatment in a temperature range of from 400 to 560° C. for 12 to 60 hours. Preferably, the multi-stage homogenization treatment is carried out in 3 to 6 stages, wherein the temperature of the first stage is lower than 465° C., the temperature of the final stage is higher than 540° C., and the holding time is more than 6 hours.

In step 3), the following procedures are carried out: (1) the ingot is firstly subject to preheating treatment at a temperature of 380 to 460° C. for 1 to 6 hours in a manner of furnace heating, and then undergoes hot rolling deformation treatment in an alternating direction or a forward direction where the initial rolling temperature is 380 to 450° C. and the finish: rolling temperature is 320 to 400° C., with the deformation amount of more than 60%, to produce a hot-rolled blank having a thickness of 5 to 10 mm; (2) the hot-rolled blank is subject to intermediate annealing treatment at a temperature of 350 to 450° C. with a holding time of 0.5 to 10 hours, and air cooled; (3) the annealed blank is subject to cold-rolling deformation process at a temperature of from room temperature to 200° C. with the total deformation of more than 65%, to produce the desired thickness specification of product. Preferably, in step (3), a second intermediate annealing treatment is carried out at 350-450° C. for 0.5-3 hours between passes of the cold-rolling deformation process.

In step 4), the solution heat treatment further adjusts the grain size and the proportion of the re-crystallized structure in the sheet in accordance with the requirements of performance, and is carried out in a manner selected from the group consisting of: (1) two or multi-stage solution heat treatment at a temperature ranging from 440 to 560° C. for a total of 0.1 to 3 hours in a manner of furnace heating; (2)

progressive solution heat treatment at a temperature ranging from 440 to 560° C. for a total 0.1 to 3 hours. In a preferable aspect, the step is carried out in a progressive manner, and 0° C./min<heating rate<60° C./min.

In step 5), the aluminum alloy sheet is rapidly cooled to room temperature by means selected from the group consisting of cooling medium spraying quenching, forced-air cooling quenching, immersion quenching, and any combination thereof.

In step 6), the aging treatment is carried by means select from the group consisting of: (1) a natural aging treatment at an ambient temperature of ≤40° C. for of ≥14 days after completion of quench-cooling; (2) a single-, two-, or multi-stage artificial aging treatment at a temperature ranging from 60 to 200° C. for total 1 to 600 minutes within 2 hours from the completing of quench-cooling; and (3) a combination of natural aging treatment with artificial aging treatment after completion of quench-cooling. Preferably, the artificial aging treatment is carried out at a temperature ranging from 60 to 200° C. for of 1 to 600 minutes; and the natural aging treatment is carried out for 2 to 360 hours.

In a preferable aspect, the method can further comprise, between step (5) and step (6), an additional step of straightening the cooled sheet by means selected from the group consisting of roll straightening, tension straightening, stretch bending straightening, and any combination to eliminate the sheet defects and enhance the sheet flatness, thereby facilitating subsequent processing.

Of those, an aluminum alloy sheet made from the aluminum alloy according to the present invention has a yield strength of ≤150 MPa and an elongation of ≥25%; and after stamping deformation and conventional baking treatment (170-180° C./20-30 min), the aluminum alloy sheet exhibits a yield strength of ≥220 MPa and a tensile strength of ≥290 MPa. Namely, the yield strength after baking is increased by more than 90 MPa. In a preferable aspect, the aluminum alloy sheet has a yield strength of ≤140 MPa and an elongation of ≥26%; and after conventional baking treatment, the aluminum alloy sheet exhibits a yield strength of ≥235 MPa and a tensile strength≥310 MPa. Namely, the yield strength of the aluminum alloy sheet after baking is increased by more than 100 MPa. In a further preferable aspect, the aluminum alloy sheet has a yield strength of ≤140 MPa and an elongation of ≥27%; and after conventional baking treatment, the aluminum alloy sheet exhibits a yield strength of ≥245 MPa and a tensile strength≥330 MPa. Namely, the yield strength after baking is increased by more than 110 MPa.

In an aspect, the aluminum alloy material according to the present invention can be welded together with itself or another alloy by means selected from the group consisting of friction stirring welding, melting welding, soldering/brazing, electron beam welding, laser welding, and any combination thereof, to form a product.

The present invention further provides a final component which is produced by the surface treatment, stamping process, and/or baking treatment of an aluminum alloy sheet made from the aluminum alloy material according to the present invention. Preferably, the final component is an external or internal panel of an automotive body.

The benefits of the present invention comprise:

(1) The optimized composition of Al—Mg—Si-based aluminum alloy, together with the matching preparation method achieve an enhancement of response capability to bake hardening of alloy by the cooperation of both Mg/Si and Mg/Zn aging precipitation sequences, so that the material exhibits both a high-bake hardening property and good formability, while further having good corrosion resistance and surface quality. Such material having a good comprehensive property is a desirable material for the manufacture of automotive body panels, and can satisfy the strict requirements of the automotive manufacturing industry for aluminum alloy body panels.

(2) The present invention further discovers the potentials of age hardening of aluminum alloys without a need of modifying existing baking processes and apparatuses of automotive factories. Thus, it will encourage strongly the automotive factories to widely replace steel with such aluminum alloy material to produce external body stampings of automobiles, facilitates to push the development of automotive light-weighting, and has important social and economic benefits.

(3) The material according to the present invention has superior performance, moderate cost, simple and practical preparation, good operability, as well as ease of industrialization and generalization, and thus has a considerable market prospect.

Hereinafter the aluminum alloy material according to the present invention and the method of preparing the same are further described with reference to the accompanying drawings. These examples are not limitative, but illustrative for the present invention.

EXAMPLE 1

For demonstrating the concept of the present invention, alloys were prepared in a laboratory scale. The compositions of the test alloys are shown in Table 1. A slab ingot having a thickness specification of 60 mm was prepared by well-known procedures including alloy melting, degasification, removal of inclusion, and simulated DC casting. The resultant ingot was charged into a resistance-heated furnace at a temperature of less than 360° C. to undergo a slow progressive homogenization treatment for a total of 36 hours, where the heating rate was strictly controlled in the range of 5 to 10° C./h. After completion of homogenization, the ingot was air cooled. The cooled ingot was subject to skin peeling, face milling, and saw cutting, thereby producing a rolled blank having a thickness specification of 40 mm. The blank was pre-heated at 450±10° C. for 2 hours. The pre-heated blank was rolled along with the width direction of the slab ingots for 2 to 3 passes; and then rolled in a different direction, namely, rolled along the length directions of the slab ingots to a thickness specification of about 6 mm, where the initial rolling temperature was 440° C. and the finish rolling temperature was 340° C. The rolled sheet was cut into a specific dimension, underwent an intermediate annealing treatment at 410±5° C./2 h, and then was subject to 5 to 7 passes of cold rolling deformation treatment, thereby obtaining a thin sheet having a thickness of about 1 mm. The thin sheet was charged into an air furnace at 460° C. for undergoing a progressive solution heat treatment from 460 to 550° C. within a period of total 40 minutes. The treated thin sheet was subject to water quenching, immediately followed by a straightening treatment. Then, the sheet was subject to a two-stage pre-aging treatment under 90 to 140° C./10 to 40 min in accordance with the characteristics of alloys. The treated sheet was stored at room temperature for 2 weeks, and then was cut to give samples for tension test and cupping test. The remainder sheet was subject to a 2% pre-deformation treatment, followed by a simulated baking treatment under 175° C./20 min, and was tested in accordance with relevant standards for the yield strength ($R_{p0.2}$), elongation (A), hardening index ($n_{15}$), elastic strain ratio ($r_{15}$), cupping index ($I_E$) of alloys in the T4P state, as well as the yield strength ($R_{p0.2}$) and the tensile strength ($R_m$) of alloy in a baked state, respectively. The results were evaluated as the performance indices of sheets in a T4P state (delivery state) and a baked state, as shown in Table 2.

TABLE 1

Compositions of Test Alloys

| Alloy No. | Alloy according to the present invention (Y/N) | Si (wt %) | Mg (wt %) | Zn (wt %) | Cu (wt %) | Mn (wt %) | Zr (wt %) | Concentrations of Primary Impurities |
|---|---|---|---|---|---|---|---|---|
| 1# | Y | 0.60 | 1.20 | 0.60 | 0.20 | 0.10 | 0.12 | Fe = 0.15, Ti = 0.02 |
| 2# | Y | 1.00 | 0.80 | 0.60 | 0.15 | 0.10 | 0.10 | Fe = 0.15, Ti = 0.02 |
| 3# | Y | 1.20 | 1.00 | 0.60 | 0.05 | 0.05 | 0.15 | Fe = 0.10, Ti = 0.02 |
| 4# | Y | 0.90 | 0.70 | 0.60 | 0.20 | 0.10 | 0.10 | Fe = 0.15, Ti = 0.02 |
| 5# | Y | 0.90 | 1.30 | 0.80 | 0.10 | 0.10 | 0.10 | Fe = 0.15, Ti = 0.02 |
| 6# | Y | 1.00 | 1.00 | 0.50 | 0.20 | 0.20 | 0.02 | Fe = 0.15, Ti = 0.02 |
| 7# | Y | 0.90 | 0.90 | 0.30 | 0.20 | 0.10 | 0.11 | Fe = 0.15, Ti = 0.02 |
| 8# | Y | 0.90 | 0.70 | 0.70 | 0.15 | 0.03 | 0.19 | Fe = 0.05, Ti = 0.02 |
| 9# | Y | 0.80 | 0.90 | 0.25 | 0.20 | 0.15 | 0.05 | Fe = 0.15, Ti = 0.02 |
| 10# | N | 0.90 | 0.90 | 0.60 | 0.50 | 0.10 | 0.12 | Fe = 0.10, Ti = 0.02 |
| 11# | N | 0.80 | 0.80 | 0.50 | 0.60 | 0.10 | 0.00 | Fe = 0.10, Ti = 0.02 |
| 12# | N | 0.80 | 0.75 | 1.06 | 0.20 | 0.12 | 0.04 | Fe = 0.10, Ti = 0.02 |
| 13# | N | 1.00 | 1.20 | 0.70 | 0.20 | 0.10 | 0.10 | Fe = 0.12, Ti = 0.02 |
| 14# | N | 0.60 | 0.70 | 0.50 | 0.15 | 0.10 | 0.10 | Fe = 0.12, Ti = 0.02 |
| 15# | N | 0.85 | 0.75 | 0.25 | 1.00 | 0.25 | 0.25 | Fe = 0.50*, Ti = 0.05*, Cr = 0.15* |
| 16# | N | 1.10 | 0.60 | 0.15 | 0.05 | 0.12 | / | Fe = 0.10*, Ti = 0.15 |
| 17# | N | 0.80 | 1.00 | 0.70 | 0.40 | / | / | Fe = 0.10, Ti = 0.02, Cr = 0.20* |
| 18# | N | 0.68 | 0.95 | 0.20 | / | 0.20 | / | Fe = 0.10, Ti = 0.02 |
| 19# | N | 0.90 | 0.90 | 0.73 | 0.75 | / | / | Fe = 0.10, Ti = 0.02, Cr = 0.25* |

*NOTE: indicating that the specified element was an specially-added microelement, other than an impurity element.

TABLE 2

Results of Performance Tests of Alloys

| | T4P State | | | | | Baked State | | |
|---|---|---|---|---|---|---|---|---|
| Alloy No. | $R_{p0.2}$ (MPa) | A (%) | $n_{15}$ | $r_{15}$ | $I_E$ (mm) | $R_{p0.2}$ (MPa) | $R_m$ (MPa) | $\Delta R_{p0.2}$ (MPa) |
| 1# | 124 | 27.5 | 0.27 | 0.70 | 8.8 | 303 | 230 | 106 |
| 2# | 144 | 27.0 | 0.28 | 0.69 | 8.6 | 334 | 254 | 110 |
| 3# | 137 | 26.5 | 0.30 | 0.71 | 8.8 | 340 | 262 | 125 |
| 4# | 136 | 29.5 | 0.29 | 0.67 | 8.7 | 333 | 250 | 114 |
| 5# | 147 | 26.0 | 0.29 | 0.66 | 8.5 | 344 | 261 | 114 |
| 6# | 138 | 30.0 | 0.28 | 0.70 | 8.8 | 338 | 258 | 120 |
| 7# | 130 | 31.5 | 0.30 | 0.75 | 8.9 | 332 | 249 | 119 |
| 8# | 133 | 27.0 | 0.27 | 0.70 | 8.4 | 319 | 240 | 107 |
| 9# | 129 | 32.5 | 0.27 | 0.71 | 8.6 | 329 | 247 | 118 |
| 10# | 165 | 25.0 | 0.26 | 0.72 | 8.4 | 334 | 257 | 92 |
| 11# | 163 | 24.0 | 0.28 | 0.70 | 8.3 | 329 | 248 | 85 |
| 12# | 145 | 21.0 | 0.25 | 0.64 | 7.9 | 322 | 236 | 91 |
| 13# | 166 | 25.0 | 0.28 | 0.71 | 8.1 | 347 | 260 | 94 |
| 14# | 123 | 29.5 | 0.29 | 0.72 | 8.3 | 316 | 208 | 85 |
| 15# | 173 | 27.5 | 0.27 | 0.70 | 8.0 | 331 | 239 | 66 |
| 16# | 137 | 28.0 | 0.29 | 0.71 | 8.5 | 305 | 219 | 82 |
| 17# | 154 | 22.5 | 0.27 | 0.64 | 7.7 | 325 | 240 | 86 |
| 18# | 125 | 29.0 | 0.26 | 0.74 | 8.4 | 277 | 202 | 77 |
| 19# | 172 | 22.5 | 0.27 | 0.65 | 7.8 | 348 | 263 | 91 |

It can be seen from Table 2 that Alloys 1#, 2#, 3#, 4#, 5#, 6#, 7#, 8#, and 9# are all well-matched between the formability and bake hardening in a T4P-state. In the case of a delivery state, these alloys exhibit yield strengths maintained below 150 MPa and elongations higher than 26.0%, and have good deep drawing property. Meanwhile, after conventional baking treatment, the yield strengths of the alloys are increased by 105 MPa or more, and the tensile strengths are higher than 300 MPa. The performances of Alloys 10#, 11#, 12#, 13#, 14#, 15#, 16#, 17#, 18#, and 19# do not satisfy the aforesaid well-matching between formability and bake hardening, thereby causing an undesirable comprehensive property of alloy. Of those, Alloys 10#, 11#, 15#, 17#, and 19# have a relatively higher alloy content or Cu content, and the yield strengths of alloys in a delivery state are relatively too high for stamping formation. Alloy 12# has a relatively high Zn content, and the elongation of alloy in a delivery state is too low for stamping formation. Alloys 13# and 14# satisfy the composition requirement of alloy, but do not satisfy the component ratio requirement, and the former has a relatively high yield strength in delivery state, and the latter has a relatively poor performance. Alloy 16#, which is compositionally similar to 6016 Alloy, has good formability, but the bake hardening property thereof is limited. Alloy 18# has a relatively low Zn content and is free of microelements Mn and Zr; and the comprehensive performance of this alloy is relatively poor.

EXAMPLE 2

Aluminum alloy sheets having different Zn levels were prepared in a lab. The compositions of test alloys are shown in Table 3. A slab ingot having a thickness specification of 60 mm was prepared by well-known procedures including alloy melting, degasification, removal of inclusion, and simulated DC casting. The resultant ingot was subject to a single-stage homogenization under 550-13° C./24 h and a progressive homogenization (at a temperature ranging from 360 to 560° C. for total 30 hours with the heating rate of 6 to 9° C./h). After completion of homogenization, air cooling followed. The ingot was subject to metallographic phase observation and electronic microscope observation. The observations in combination with DSC analysis were used for analyzing the over-burning of alloy structures. The results are shown in Table 4.

TABLE 3

Compositions of Test Alloys

| Alloy No. | Alloy according to the present invention (Y/N) | Si (wt %) | Mg (wt %) | Zn (wt %) | Cu (wt %) | Mn (wt %) | Zr (wt %) | Concentrations of primary impurities (wt %) |
|---|---|---|---|---|---|---|---|---|
| 20# | N | 0.90 | 0.90 | <0.01 | 0.20 | 0.10 | 0.12 | Fe = 0.20, Ti = 0.02 |
| 21# | Y | 0.90 | 0.90 | 0.60 | 0.20 | 0.10 | 0.12 | Fe = 0.20, Ti = 0.02 |
| 22# | N | 0.90 | 0.90 | 1.20 | 0.20 | 0.10 | 0.12 | Fe = 0.20, Ti = 0.02 |

TABLE 4

Over-Sintering of Structures of Test Alloys After Different Homogenization Treatments

| Alloy No. | Processes of Homogenization Treatments | Over-Sintering (Y/N) |
|---|---|---|
| 20# | Single-stage, 550 ± 3° C./24 h | N |
| | Progressive homogenization (Temperature: 360 to 560° C.; total time: 30 hours; heating rate: 6 to 9° C./h) | N |
| 21# | Single stage, 550 ± 3° C./24 h | Y |
| | Progressive homogenization (Temperature: 360 to 560° C.; total time: 30 hours; heating rate: 6 to 9° C./h) | N |
| 22# | Single stage, 550 ± 3° C./24 h | Y |
| | Progressive homogenization (Temperature: 360 to 560° C.; total time: 30 hours; heating rate: 6 to 9° C./h) | N |

It can be seen from the analysis of the aforesaid results that for Al—Mg—Si—Cu-based alloys in which Zn is incorporated, single-staged high temperature homogenization will cause the occurrence of over-burning. Thus, the slab ingots of test alloys 20#, 21# and 22# are all treated with the progressive homogenization (temperature: 360 to 560° C.; total time: 30 hours; heating rate: 6 to 9° C./h). After rolling, solution, pre-aging and simulated baking treatments similar to Example 1, the alloy sheets were tested for the yield strength ($R_{p0.2}$), elongation (A), hardening index ($n_{15}$), elastic strain ratio ($r_{15}$), and cupping index ($I_E$) in delivery state, as well as the yield strength ($R_{p0.2}$), the tensile strength ($R_m$) and the intercrystalline corrosive property in baked state, respectively. The results were evaluated as the performance indices of sheets in a T4P state (delivery state) and a baked state, as shown in Table 5.

TABLE 5

Results of Performance Tests of Alloys

| Alloy No. | T4P State $R_{p0.2}$ (MPa) | A (%) | $n_{15}$ | $r_{15}$ | $I_E$ (mm) | Baked State $R_{p0.2}$ (MPa) | $R_m$ (MPa) | $\Delta R_{p0.2}$ (MPa) | Rating of Intercrystalline Corrosion |
|---|---|---|---|---|---|---|---|---|---|
| 20# | 126 | 29.5 | 0.27 | 0.71 | 8.9 | 283 | 204 | 78 | 1 |
| 21# | 137 | 28.5 | 0.29 | 0.70 | 8.7 | 342 | 251 | 114 | 1 |
| 22# | 157 | 20.5 | 0.28 | 0.64 | 7.8 | 353 | 259 | 102 | 3 |

It can be seen from Table 5 that Alloy 21# according to the present invention has both good formability and good bake hardening property in a T4P state. However, Alloy 20# comprising no Zn exhibits good formability, but has relatively low response capability to bake hardening; and Alloy 22# having a relatively high Zn level has a relatively good response capability, but exhibits substantively decreased formability and corrosion resistance; thus, they are unlikely to satisfy the requirements for manufacturing automotive body panels.

EXAMPLE 3

Aluminum alloy sheets having different Cu levels were produced in a lab. The compositions of the aluminum alloys are shown in Table 6. Casting ingots were obtained by procedures similar to Example 1: The ingots were charged into a resistance-heated furnace at a temperature of less than 380° C. to undergo a multi-stage homogenization treatment for total 48 hours, and then air cooled. The cooled ingots were subject to skin peeling, face milling, and saw cutting, thereby producing rolled blanks having a thickness specification of 40 mm. The blanks were pre-heated at 425±10° C. for 4 hours. The pre-heated blanks were rolled along with the width direction of the slab ingots for 2 to 3 passes; and then rolled in a different direction, namely, rolled along with the length direction of the slab ingots to a thickness specification of about 6 mm, where the primary rolling temperature was 420° C. and the finish rolling temperature was 320° C. The rolled sheet was cut into a specific dimension, underwent an intermediate annealing treatment at 380±5° C./4 h, and then was subject to 5 to 7 passes of cold rolling deformation treatment, thereby obtaining a thin sheet having a thickness of about 1.1 mm. The thin sheet was subject to a two-stage solution heat treatment in a salt bath tank under (465±5° C./20 min)+(550±5° C./10 min). The treated thin sheet was subject to water quenching, immediately followed by a straightening treatment. Then, the sheet was subject to a three-stage artificial pre-aging treatment under 85 to 145° C./10 to 50 min in accordance with the characteristics of alloys. The treated sheet stored at room temperature for 2 weeks, and then was cut to give samples for tension test and cupping test. The remainder sheet was subject to a 2% pre-deformation treatment, followed by a simulated baking treatment under 175° C./20 min, and was tested in line with relevant standards for the yield strength ($R_{p0.2}$), elongation (A), hardening index ($n_{15}$), elastic strain ratio ($r_{15}$), cupping index ($I_E$) of alloys in the T4P state, as well as the yield strength ($R_{p0.2}$) and the tensile strength ($R_m$) of alloy in a baked state, respectively. The results were evaluated as the performance indice of sheets in a T4P state (delivery state) and a baked state, as shown in Table 7.

TABLE 6

| Compositions of Test Alloys | | | | | | | | |
|---|---|---|---|---|---|---|---|---|
| Alloy No. | Alloy according to the present invention (Y/N) | Si (wt %) | Mg (wt %) | Zn (wt %) | Cu (wt %) | Mn (wt %) | Zr (wt %) | Concentrations of primary impurities (wt %) |
| 23# | N | 0.90 | 0.95 | 0.55 | <0.01 | 0.10 | 0.11 | Fe = 0.15, Ti = 0.02 |
| 24# | Y | 0.90 | 0.95 | 0.55 | 0.13 | 0.10 | 0.11 | Fe = 0.15, Ti = 0.02 |
| 25# | N | 0.90 | 0.95 | 0.55 | 0.6 | 0.10 | 0.11 | Fe = 0.15, Ti = 0.02 |

TABLE 7

| Results of Performance Tests of Alloys | | | | | | | | | |
|---|---|---|---|---|---|---|---|---|---|
| | T4P State | | | | | Baked State | | | Rating of |
| Alloy No. | $R_{p0.2}$ (MPa) | A (%) | $n_{15}$ | $r_{15}$ | $I_E$ (mm) | $R_{p0.2}$ (MPa) | $R_m$ (MPa) | $\Delta R_{p0.2}$ (MPa) | Intercrystalline Corrosion |
| 23# | 129 | 29.0 | 0.29 | 0.73 | 8.8 | 309 | 217 | 88 | 1 |
| 24# | 134 | 30.0 | 0.30 | 0.73 | 9.0 | 338 | 250 | 116 | 1 |
| 25# | 157 | 20.5 | 0.28 | 0.64 | 8.3 | 343 | 259 | 102 | 2 |

It can be seen from Table 7 that Alloy 24# according to the present invention has both good formability and good bake hardening property in T4P state. However, Alloy 23# comprising no Cu exhibits good formability, but has relatively low response capability to baking hardening; and Alloy 25# having a relatively high Cu level has a relatively good response capability, but exhibits substantively decreased corrosion resistance; thus, they are unlikely to satisfy the requirements for manufacturing automotive body panels.

EXAMPLE 4

Aluminum alloy sheets having different Mn and Zr levels were produced in a lab. The compositions of the alloys are shown in Table 8. The sheets were treated by the same procedures as Example 3 including melting, homogenization, rolling, solution heat treatment and quenching, as well as pre-aging and simulated baking, and the like. In according with the relevant test standards, the alloy sheets were tested for the yield strength ($R_{p0.2}$), elongation (A), hardening index ($n_{15}$), elastic strain ratio ($r_{15}$), cupping index ($I_E$) in a T4P state and the yield strength ($R_{p0.2}$), the tensile strength ($R_m$), and intercrystalline corrosion property in a baked state, respectively. The results were evaluated as the performance indices of sheets in a T4P state (delivery state) and a baked state, as shown in Table 9.

TABLE 8

| Compositions of Test Alloys | | | | | | | | |
|---|---|---|---|---|---|---|---|---|
| Alloy No. | Alloy according to the present invention (Y/N) | Si (wt %) | Mg (wt %) | Zn (wt %) | Cu (wt %) | Mn (wt %) | Zr (wt %) | Concentrations of primary impurities (wt %) |
| 26# | N | 0.80 | 0.90 | 0.50 | 0.20 | <0.01 | <0.01 | Fe = 0.15, Ti = 0.02 |
| 27# | N | 0.80 | 0.90 | 0.50 | 0.20 | 0.20 | <0.01 | Fe = 0.15, Ti = 0.02 |
| 28# | Y | 0.80 | 0.90 | 0.50 | 0.20 | 0.10 | 0.11 | Fe = 0.15, Ti = 0.02 |

TABLE 9

| Results of Performance Tests of Alloys | | | | | | | | | |
|---|---|---|---|---|---|---|---|---|---|
| | T4P State | | | | | Baked State | | | Average |
| Alloy No. | $R_{p0.2}$ (MPa) | A (%) | $n_{15}$ | $r_{15}$ | $I_E$ (mm) | $R_{p0.2}$ (MPa) | $R_m$ (MPa) | $\Delta R_{p0.2}$ (MPa) | grain size (μm) |
| 26# | 132 | 27.0 | 0.25 | 0.63 | 7.5 | 327 | 238 | 106 | 123 |
| 27# | 137 | 28.5 | 0.28 | 0.69 | 8.0 | 332 | 242 | 105 | 87 |
| 28# | 140 | 31.0 | 0.30 | 0.72 | 8.8 | 338 | 255 | 115 | 50 |

It can be seen from Table 9 that Alloy 28# according to the present invention has both good formability and good bake hardening property in a T4P state. However, Alloy 26# which is free of Mn and Zr exhibits a relatively high response capability to bake hardening, but has a relatively poor formability due to coarse grain size thereof. In addition, Alloy 27# comprising no Zr exhibits a relatively high response capability to bake hardening, but having a relatively high Cu level has a relatively good response capability, whereas the formability thereof is better than Alloy 27#, but substantially inferior as compared with Alloy 28# according to the present invention.

EXAMPLE 5

Alloys were produced in an industrial scale, and the compositions of the alloys are as shown in Table 10. Slab ingots having a thickness specification of 180 mm were produced via well known procedures including melting, degasification, removal of inclusion, and simulated DC casting. Then, the ingot of Alloy 25# was homogenized with a progressive homogenization treatment (at a temperature ranging from 360 to 555° C., total time: 30 hours; heating rate: 5 to 9° C./h), and the remainder alloys were treated via conventional annealing treatment (550±5° C./24 h). Then, the ingots were air cooled. The cooled ingots were subject to skin peeling, face milling, and saw cutting, thereby producing rolled blanks having a thickness specification of 120 mm. The blanks were pre-heated at 445±10° C. for 5 hours. The pre-heated blank was subject to 6 to 10 passes of forward rolling thermal-deformation process to obtain rolled sheet blanks having a thickness of about 10 mm, wherein the initial rolling temperature was 440° C., and the finish rolling temperature was 380° C. The rolled sheets were cut into a specific dimension, and underwent an intermediate annealing treatment at 410±5° C./2 h. After completion of intermediate annealing, the sheet blanks were subject to 2 to 4 passes of cold rolling deformation treatment at a temperature ranging form room temperature to 200° C. to reach a 5 mm thickness specification. Then, the sheet blanks were subject to a further intermediate annealing treatment under 360-420° C./1-2.5 h. After complete cooling, the sheets continued to undergo cold rolling deformation to produce thin sheets having a 0.9 mm thickness specification. The thin sheets were charged into an air furnace at 460° C. to undergo a progressive solution heat treatment from 440 to 550° C. for a total of 40 min. After water quenching, the sheets were subject to leveling treatment, followed by a single- or two-stage pre-aging treatment at 90-140° C. for 10-40 min, respectively, in accordance the characteristics of alloys per se. Then, the sheets were stored at room temperature for 2 weeks, and underwent tension testing and cupping testing in accordance with relevant methods. Moreover, the sheets were subject to 2% pre-deformation treatment, and then subject to simulated bake heating treatment at 175° C. for 30 min. According to the relevant test standards, the alloy sheets were tested for the yield strength ($R_{p0.2}$), elongation (A), hardening index ($n_{15}$), elastic strain ratio ($r_{15}$), cupping index ($I_E$) in a T4P state and the yield strength ($R_{p0.2}$), the tensile strength ($R_m$), and intercrystalline corrosion property in a baked state, respectively. The results were evaluated as the performance indices of sheets in a T4P state (delivery state) and a baked state. Meanwhile, the surface quality of sheets was observed via a simulated punching test. The results are shown in Table 11.

TABLE 10

Composition of Alloys

| Alloy No. | Alloy of the present invention (Y/N) | Si (wt %) | Mg (wt %) | Zn (wt %) | Cu (wt %) | Mn (wt %) | Zr (wt %) | Fe (wt %) | Concentrations of primary impurities (wt %) |
|---|---|---|---|---|---|---|---|---|---|
| 29# | Y | 0.90 | 0.95 | 0.50 | 0.16 | 0.10 | 0.10 | / | Fe = 0.15, Ti = 0.02 |
| 30# | N | 1.25 | 0.43 | / | / | / | / | / | Fe = 0.15, Ti = 0.02 |
| 31# | N | 0.85 | 0.75 | / | 0.70 | 0.28 | / | / | Fe = 0.15, Ti = 0.02 |
| 32# | N | 1.10 | 0.58 | / | 0.06 | 0.06 | / | 0.13 | Ti = 0.02 |

NOTE:

The compositions of Alloys 26#, 27#, and 28# are median values of the compositions of 6016, 6111 and 6022 aluminum alloys as registered in the International Aluminum Association.

TABLE 11

Results of Performance Tests of Alloys

| | T4P State | | | | | Baked State (PB) | | | Surface quality after |
|---|---|---|---|---|---|---|---|---|---|
| Alloy No. | $R_{p0.2}$ (MPa) | A (%) | $n_{15}$ | $r_{15}$ | $I_E$ (mm) | $R_{p0.2}$ (MPa) | $R_m$ (MPa) | $\Delta R_{p0.2}$ (MPa) | punch formation |
| 29# | 133 | 30.5 | 0.29 | 0.72 | 8.9 | 346 | 254 | 121 | good |
| 30# | 130 | 27.0 | 0.29 | 0.62 | 9.2 | 278 | 209 | 79 | common |
| 31# | 162 | 28.5 | 0.29 | 0.68 | 7.7 | 339 | 250 | 88 | good |
| 32# | 136 | 29.0 | 0.28 | 0.70 | 7.9 | 301 | 230 | 94 | good |

It can be seen from Table 11 that Alloy 29# according to the present invention exhibits both good formability in a T4P state and good bake hardening response, and has substantially superior comprehensive performances as compared with 6016 alloy (Alloy 30#), 6111 alloy (Alloy 31#), 6022 alloy (Alloy 32#) produced under equivalent conditions. In particular, the alloy according to the present invention exhibits substantially improved response capability to bake hardening while maintaining the good formability, and thus can further satisfy the requirements for the manufacture of automotive body panels. FIG. 1 indicates the comparison of essential properties of Alloy 29# according to the present invention, 6016 alloy, 6111 alloy, and 6022 alloy. It can be seen that the alloy product according to the present invention has both good fomability and good bake hardening.

We claim:

1. An aluminum alloy material for use in the manufacture of automotive body panels, consisting of, based on the total weight of the aluminum alloy material, Si 0.6 to less than 0.9 wt %,
Mg 0.7 to 1.3 wt %,
Zn 0.55 to 0.8 wt %,
Cu 0.05 to 0.20 wt %,
Mn 0.01 to 0.25 wt %,
Zr 0.01 to 0.20 wt %, and
the balance being Al and incidental elements,
wherein the incidental elements are impurities or entrained by grain refinement in the manufacture of aluminum alloy ingots and comprise Fe and Ti, wherein Fe≤0.40 wt %, T3<0.15 wt %,
wherein the aluminum alloy material does not comprise additionally added Cr, and
wherein the aluminum alloy material satisfies the inequation of:

$$2.50\text{ wt }\% \leq (Si+Mg+Zn+2Cu) \leq 3.20\text{ wt }\%.$$

2. The aluminum alloy material for use in the manufacture of automotive body panels according to claim 1, consisting of, based on the total weight of the aluminum alloy material:

Si 0.6 to less than 0.9 wt %,
Mg 0.7 to 1.2 wt %,
Zn 0.55 to 0.8 wt %,
Mn 0.05 to 0.15 wt %,
Zr 0.05 to 0.15 wt %, and
the balance being Al and incidental elements,
wherein the incidental elements are impurities or entrained by grain refinement in the manufacture of aluminum alloy ingots and comprise Fe and Ti, wherein Fe≤0.40 w t%, Ti <0.15 wt %,
wherein the aluminum alloy material does not comprise additionally added Cr, and
wherein the aluminum alloy material satisfies the inequation of:

$$2.50\text{ wt }\% \leq (Si+Mg+Zn+2Cu) \leq 3.00\text{ wt }\%.$$

3. The aluminum alloy material for use in the manufacture of automotive body panels according to claim 1, wherein the aluminum alloy material satisfies the inequation of:

$$0.75 \leq 10Mg/(8Si+3Zn) \leq 1.15.$$

4. The aluminum alloy material for use in the manufacture of automotive body panels according to claim 1, wherein the aluminum alloy material satisfies the inequation of:

$$0.15\text{ wt }\% \leq (Mn+Zr) \leq 0.25\text{ wt }\%.$$

5. The aluminum alloy material for use in the manufacture of automotive body panels according to claim 1, wherein the incidental elements further comprise one or more elements selected from other incidental elements, wherein each of the other incidental elements ≤0.15 wt %, and the sum of the other incidental elements ≤0.25 wt %.

6. The aluminum alloy material for use in the manufacture of automotive body panels according to claim 1, wherein, in the aluminum alloy material, Fe<2Mn, wherein Fe is the incidental element.

7. The aluminum alloy material according to claim 6, wherein the aluminum alloy sheet has a yield strength of ≤140 MPa and an elongation of ≥27%; after baking treatment, the aluminum alloy sheet has a yield strength ≥245 MPa and a tensile strength ≥330 MPa;

and the yield strength after baking is increased for more than 110 MPa.

8. The aluminum alloy material according to claim 1, wherein an aluminum alloy sheet made from the aluminum alloy material has a yield strength of ≤150MPa and an elongation of ≤25%; after baking treatment, the aluminum alloy sheet has a yield strength of ≤220 MPa, and a tensile strength of ≤290 MPa; and the yield strength of the aluminum alloy sheet after baking is increased for more than 90 MPa.

9. The aluminum alloy material according to claim 1, wherein the aluminum alloy material is welded together with itself or another alloy by means selected from the group consisting of friction stirring welding, melting welding, soldering/brazing, electron beam welding, laser welding, and any combination thereof, to form a product.

10. A final component comprising the aluminum alloy material according to claim 1.

11. A method of producing an aluminum alloy material comprising the steps of:

(1) producing an casting ingot from the aluminum alloy material according to claim 1;
(2) homogenizing the resultant ingot;
(3) deforming the homogenized ingots via hot rolling and cold rolling processes to produce an aluminum alloy sheet having the desired specification;
4) solution heat treating the deformed aluminum alloy sheet;
5) cooling rapidly the treated aluminum alloy sheet to room temperature; and
6) naturally aging or artificially pre-aging the aluminum alloy sheet.

12. The method according to claim 11, wherein in step (1), the cast ingots are produced by the steps of melting, degasification, removal of inclusion, and DC casting, wherein the concentrations of elements are accurately controlled during melting by use of Mg and Zn as the core elements; and the ratios among alloying elements are rapidly supplemented and adjusted by on-line detection and analysis of components so as to complete the production of cast ingots.

13. The method according to claim 12, wherein step 1) further comprises electromagnetic stirring, ultrasonic stirring, or mechanical stirring during the processes of melting, degasification, removal of inclusion, and DC casting.

14. The method according to claim 11 wherein, in step (2), the homogenization treatment is carried out by means selected from the group consisting of:

(1) progressive homogenization treatment in a temperature range of 360 to 560° C. for 16 to 60 hours, with the heating rate ranging from 1° C./h to 30° C./h excluding 1° C./h; and
(2) multi-stage homogenization treatment in a temperature range of 400 to 560° C. for a total of 12 to 60 hours.

15. The method according to claim 11, wherein in step 3), the following procedures are carried out:

(1) the ingot is first subject to preheating treatment at a temperature of 380 to 460° C. for 1 to 6 hours in a manner of furnace heating, and then undergoes hot rolling deformation treatment in an alternating direction or a forward direction where the initial rolling temperature is 380 to 450° C. and the finish rolling temperature is 320 to 400° C., with the deformation amount of more than 60%, to produce a hot-rolled blank having a thickness of 5 to 10 mm;

(2) the hot-rolled blank is subject to intermediate annealing treatment at a temperature of 350 to 450° C. with a holding time of 0.5 to 10 hours; and (3) after completion of intermediate annealing, the blank is subject to cold rolling deformation process at a temperature of from room temperature to 200° C. with the total deformation of more than 65%, to produce the desired thickness specification of product.

16. The method according to claim 15, wherein in step (3), a second intermediate annealing treatment is carried out under 350-450° C./0.5-3 hours between passes of cold rolling deformation process.

17. The method according to claim 11, wherein, in step (4), the solution heat treatment is carried out in a manner selected from the group consisting of:

(1) two or multi- stage solution heat treatment at a temperature ranging from 440 to 560° C. for total 0.1 to 3 hours; and (2) progressive solution heat treatment at a temperature ranging from 440 to 560° C. for total 0.1 to 3 hours.

18. The method according to claim 11, wherein, in step (5), the aluminum alloy sheet is rapidly cooled to room temperature by means selected from the group consisting of cooling medium spraying quenching, forced-air cooling quenching, immersion quenching, and any combination thereof.

19. The method according to claim 11, wherein, in step (6), the aging treatment is carried by means select from the group consisting of:

(1) a natural aging treatment at an ambient temperature of ≤40° C. for of ≥14 days after completion of quench-cooling;

(2) a single-, two-, or multi-stage artificial aging treatment at a temperature ranging from 60 to 200° C. for total 1 to 600 minutes within 2 hours from the completing of quench-cooling; and (3) a combination of natural aging treatment with artificial aging treatment after completion of quench-cooling, wherein the artificial aging treatment is carried out at a temperature ranging from 60 to 200° C. for 1 to 600 minutes, and the natural aging treatment is carried out for 2 to 360 hours.

20. The method according to claim 11, further comprising, between steps (5) and (6), an additional step of straightening the cooled sheet by means selected from the group consisting of roll straightening, tension straightening, stretch-bending straightening, and any combination to eliminate the sheet defects and enhance the sheet flatness, thereby facilitating subsequent processing.

* * * * *